US005297313A

United States Patent [19]

Brin

[11] Patent Number: 5,297,313

[45] Date of Patent: Mar. 29, 1994

[54] PIVOT HINGE ASSEMBLY FOR GLASS STRUCTURES

[75] Inventor: Gavin Brin, Thornhill, Canada

[73] Assignee: Lalique Hinge Co. Inc., Thornhill, Canada

[21] Appl. No.: 45,751

[22] Filed: Apr. 14, 1993

[51] Int. Cl.[5] ..... E05D 5/02; E05D 7/08; E05F 1/14

[52] U.S. Cl. ..... 16/252; 16/281; 16/379

[58] Field of Search ..... 16/252, 281, 379

[56] References Cited

U.S. PATENT DOCUMENTS 3,657,766 4/1972 Peterson ..... 16/281
5,079,798 1/1992 Burke ..... 16/252

FOREIGN PATENT DOCUMENTS 1196541 7/1965 Fed. Rep. of Germany ..... 16/252

*Primary Examiner*—Lowell A. Larson
*Assistant Examiner*—Carmine Cuda
*Attorney, Agent, or Firm*—Bereskin & Parr

[57] ABSTRACT

A pivot hinge assembly to pivot glass structures such as shower doors. The assembly includes a first hinge member having a pivot pin projecting therefrom and secured thereto. The pin is generally cylindrical but contains two opposing flat surfaces. The pin protrudes into a bore in a central block which joins two flat plates which clamp the glass between them. The block has four bores which contain pressure assemblies to press on the flat surfaces of the pivot pin and bias the hinge assembly to a closed position.

6 Claims, 2 Drawing Sheets

PIVOT HINGE ASSEMBLY FOR GLASS STRUCTURES

FIELD OF THE INVENTION

This invention relates to a pivot hinge assembly. More particularly it relates to a pivot hinge assembly adapted for use with glass panes used in shower doors and other glass structures.

BACKGROUND OF THE INVENTION

Glass hinge assemblies are usually of the kind shown in U.S. Pat. No. 5,079,798 issued Jan. 14, 1992. Such hinge assemblies are placed on the edges of glass doors and are oriented in a vertical plane, to support the weight of the glass doors. A disadvantage of this type of hinge assembly is that it can exert undue stress on the glass, causing it to crack, and in addition it can be difficult to mount the fixed part of the hinge unless there is a sufficient structural support backing up the fixed part of the hinge. In practice, the fixed part of the hinge is usually attached through tile, marble or artificial stone, and unless there is a structural support behind this material, the fixed part of the hinge will not be adequately secured. In addition, the large hinges located along the height of the door are unsightly.

To deal with this kind of problem, in some cases hinges are placed at the bottom and top of a shower door or the like, with their pivot pins extending vertically toward the top and bottom edges of the door, as shown in U.S. Pat. No. 4,035,957 issued Jul. 19, 1977. With the arrangement shown in U.S. Pat. No. 4,035,957, the bottom hinge bears the weight of the door as a compressive force. Thus, the door is not hung on its edge, thereby reducing the likelihood that the door will crack. In addition, there is usually a structural support available below the bottom fixed hinge portion, facilitating installation of the hinges. The hinges being at the top and bottom of the door, are somewhat out of the way visually and are usually less unsightly.

A disadvantage of the kind of hinge shown in U.S. Pat. No. 4,035,957 is that it has not in the past been possible to provide in a simple way any self closing or detent features for such hinges. In some cases such hinges have been built with friction drums, but these simply make the door stiffer to open and close and do not provide any self closing forces. Therefore, shower doors which use top and bottom hinges have usually employed gravity forces for self closing. However this makes installation of the door more difficult, since it must be oriented at the correct angle, and in addition a stopper is needed on the door, usually in the form of a magnet or latch. This increases the cost.

BRIEF SUMMARY OF THE INVENTION

Accordingly, it is an object of the invention to provide a hinge assembly suitable for use as a top or bottom hinge for a glass door, and which hinge assembly can provide self closing forces which tend to close the door and hold it in closed position.

In one of its aspects the invention provides a two-part glass hinge assembly comprising:

(a) a first hinge member adapted to be clamped to a glass plate and comprising:

(i) first and second plate portions adapted to lie in parallel planes one on each side of said glass plate and having a pair of ends lying in a common plane, (ii) a block portion of smaller lateral dimensions than those of said plate portions and adapted to lie between said plate portions and to be connected thereto, (iii) said block portion having a flat end lying in said plane, said flat end thereby being flush with said ends of said first and second plate portions, said block portion having first and second side surfaces extending at right angles to said flat end and to the planes of said side plates, (iv) said block portion having a first bore extending into said block portion perpendicular to said flat end thereof, said bore having an inner closed end, (v) said block portion having second and third threaded bores in said first side surface thereof and fourth and fifth threaded bores in said second side surface thereof, each of said second to fifth bores extending perpendicular to its respective side surface and intersecting said first bore, (b) a second hinge be connected to a support structure and having a flat end surface adapted to overlie said flat end of said block portion, (c) a pivot pin connected to and protruding from said end surface of said second hinge member and extending into said first bore, said pivot pin being rounded in cross-section but having a pair of opposed flat surface portions one extending along each side thereof, and having a free end adjacent said inner closed end of said first bore, (d) pressure pad means located in each of said second to fifth bores for resiliently pressing on said flat surface portions of said pivot pin to bias said pivot pin to a selected position, (e) each of said pressure pad means including spring means, and adjustable screw means for adjusting the pressure of each of said pressure pad means on said pivot pin.

Further objects and advantages of the invention will appear from the following description, taken together with the accompanying drawings.

DETAILED DESCRIPTION OF PREFERRED EMBODIMENTS

Figure 1:
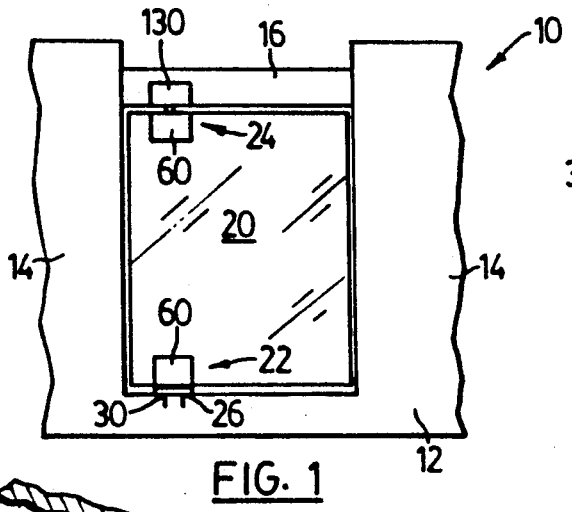
FIG. 1 is a diagrammatic view of a shower stall having a shower door employing hinges according to the invention.

Reference is first made to FIG. 1, which shows a shower stall generally indicated at 10. The shower stall 10 has a front bottom wall 12, front side walls 14, and a front upper glass wall 16 extending between the side walls 14. The walls 12, 14, 16 define an opening 18 which receives a shower door 20.

The shower door 20 is pivotally mounted in the opening 18 by a bottom hinge 22 and a top hinge 24. Hinges 22, 24 both employ the features of the invention, and hinge 22 will next be described, with reference to FIGS. 2 to 5.

Hinge 22 includes a fixed hinge member 26, in the form of a flat relatively thin rectangular bar. Hinge member 26 includes a pair of screw holes 28 adapted to receive downwardly extending screws 30 (FIG. 1) to secure hinge member 26 to the upper surface 7 of bottom wall 12.

Hinge member 26 also includes (FIG. 2) a central bore 34 extending from a rear surface 36 toward the front surface 38 of the hinge member 26. The bore 34 opens into a square recess 40 sunk into the center of the front surface 38 of the hinge member 26.

Figure 2:
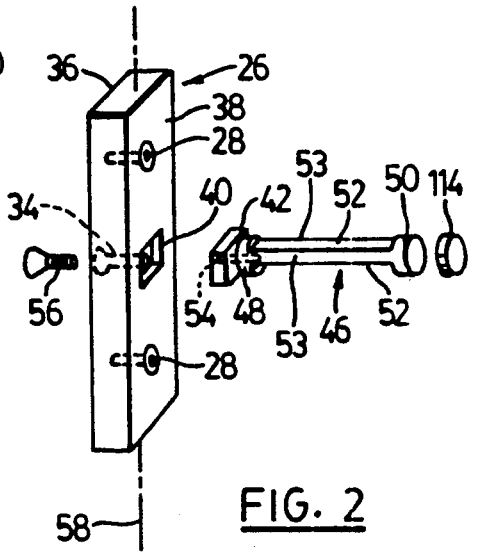
FIG. 2 is a perspective exploded view of a fixed hinge member and pivot pin according to the invention, and showing a pane of glass on which it is mounted.

As best shown in FIG. 2, the square recess 40 snugly accepts the square end 42 of a pivot pin 46. The pivot pin 46 includes a generally cylindrical shaft portion 48 extending from the square end 42 to a free end 50. The shaft portion 48 contains two flat surfaces 52, one on each side thereof, and extending over most of the length of the pivot shaft 46 between the square end 42 and the free end 50. The flat surfaces 52 are formed by curved surfaced 53. Only a short portion of the length of the pivot pin 46 adjacent the free end 50, and a further short portion adjacent the square end 42, is fully cylindrical.

The pivot shaft 46 contains an axial internal threaded bore 54 extending into its square end 42. The pivot shaft 46 is rigidly secured to the hinge member 26 by a countersunk screw 56 which extends from the rear side of hinge member 26 through bore 34 and into the bore 54. In use, the pivot pin 46 will be oriented so that the flat surfaces 50 are perpendicular to the longitudinal axis 58 of the hinge member 26.

Figure 3:
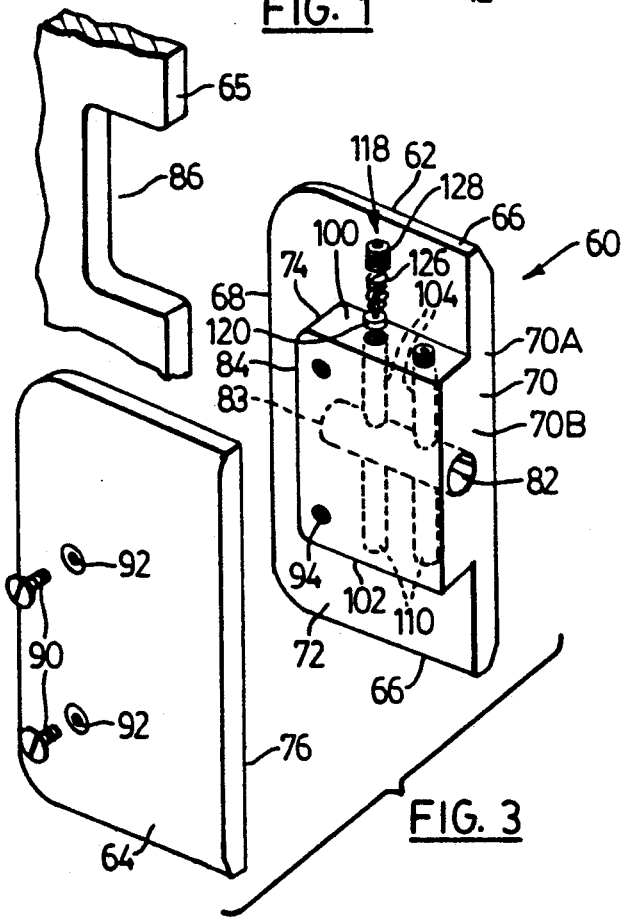
FIG. 3 is a perspective exploded view of a door mounted hinge member, according to the invention.
Figure 4:
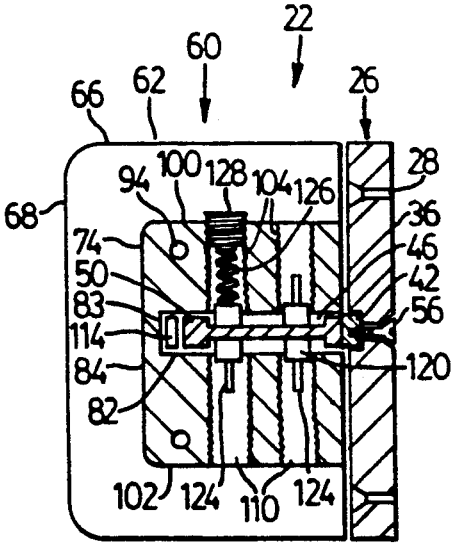
FIG. 4 is a plan view, partly in section, of a portion of the hinge member of FIG. 3 assembled to the hinge member of FIG. 2.
Figure 5:
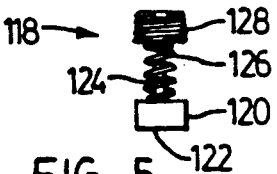
FIG. 5 is a side view, partly in section, showing a pressure pad assembly used in a hinge of the invention.

Reference is next made to FIGS. 3 to 5, which show the other hinge member 60 of hinge 22. The hinge member 60 includes a pair of plate members 62, 64 which are adapted to lie one on each side of a glass pane, a portion of which is shown at 65 in FIG. 3. The glass pane 65 forms part of the door 20 or other structure to be hinged.

The hinge plate 62 includes side edges 66, and end edge 68, and a flat pivot edge 70A. The hinge plate 60 also includes an internal surface 72 having a block 74 mounted thereon and extending inwardly toward the internal surface 76 of the other hinge plate 64. The block 72 is recessed inwardly from the edges 66 and 68 but has a flat pivot end surface 70B which is flush with surface 70A to form a common flat pivot end surface 70.

A bore 82 extends into the block 74 from end surface 70B, at right angles to surface 70B. The bore 82 terminates at an inner end 83 spaced from the far end 84 of the block 74, as best shown in FIG. 4.

The glass pane 65 contains a cutout 86 which follows the contour of block 74, so that in practice the hinge member 60 may be placed on one side of the glass pane 65 with the block 74 located in the cutout 86, and then the other hinge plate 64 may be placed on the other side of glass pane 65 and secured by screws 90 which extend through counter sunk holes 92 in plate 76 and into threaded holes 94 in block 74. The holes 94 are spaced one on each side of bore 82.

As shown, block 74 includes two side surfaces 100, 102 which extend between the plates 62, 64 and extend parallel to the bore 82, at right angles to the end surface 70. Surface 100 contains two bores 104 extending into the block 74 at right angles to surface 100 and parallel to end surface 70. Two similar bores 110 extend into surface 102, also at right angles to surface 102 and parallel to end surface 70. The bores 104, 110 intersect bore 82 and are aligned with each other.

As best shown in FIG. 4, when the hinge members 26,62 are assembled, the pivot shaft 46 extends into the bore 82 so that its free end 50 is located adjacent the inner end 83 of bore 82 but is spaced therefrom by a plastic (e.g. nylon) cylindrical disk 114 (to avoid metal to metal contact). The pivot pin 46 can be inserted into hinge member 60 before or after pivot pin 46 is connected to hinge member 26.

After pivot pin 46 is inserted into hinge member 60, pressure assemblies 118 are inserted into each bore 104, 110. Each pressure assembly 118 includes (see also FIG. 5) a plastic bushing 120 having an enlarged cylindrical end 122 and a central shaft 124 extending therefrom. A small coil spring 126 is placed over each shaft 124 to press the enlarged end 122 against on of the flat surfaces 52 of the pivot pin 46. The spring and bushing assemblies are held in position by insert screws 128 which are inserted into each of the threaded bores 104, 110.

To install the hinge assembly shown, the pivot shaft 46 is, as discussed, first inserted into bore 82. The pressure assemblies 118 are then inserted into the four bores 104, 110 and tightened (by turning the insert screws 126 into the bores) to apply the desired degree of pressure to pivot shaft 46. This can be tested by connecting hinge member 26 to the square end 42 of pivot shaft 46 (as shown in FIG. 5) and turning it relative to hinge member 60, to determine whether the detent and self closing force exerted by pressure assemblies 120 against pivot pin 46 is adequate. The bushing ends 122 prevent withdrawal of pivot pin 46 from bore 82, partly by friction, and partly because they obstruct withdrawal of cylindrical end 50 so long as they bear wholly or largely on the flat surfaces 52.

Figure 6:
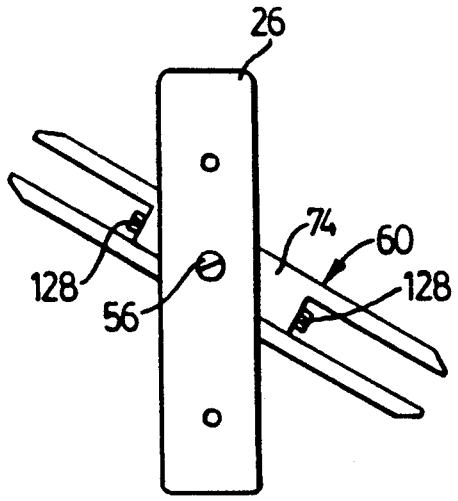
FIG. 6 is an end view of a hinge assembly according to the invention with one hinge member rotated relative to the other.
Figure 7:
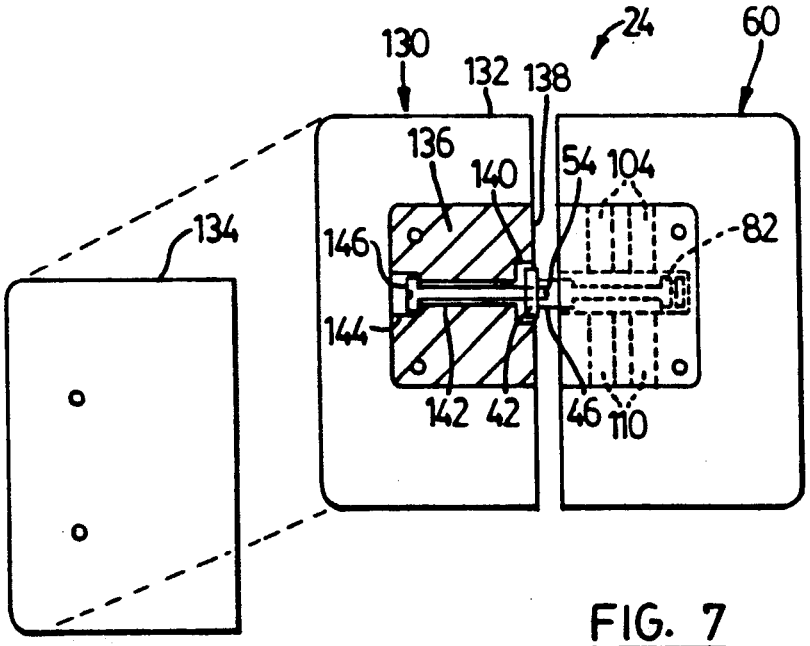
FIG. 7 is a plan view, partly in section, of a modified hinge assembly according to the invention.

After the pressure assemblies 120 have been adjusted, the hinge member 60 is connected to the glass pane 65 as described. (Normally gaskets are located between each hinge plate 62, 64 and the glass surface.) The hinge members 26, 60 are then turned relative to each other, as shown in FIG. 6, to expose screw holes 28 so that the hinge member 26 can be connected e.g. to the top surface of bottom wall 12.

The hinge members 26, 60 will typically be manufactured from a decorative material such as brass, anodized or powder coated aluminum, or stainless steel. The pivot pin 46 will normally be made of a strong material such as stainless steel, since it is in effect cantilevered and must withstand substantial forces.

The use of four pressure assemblies 120, two on each side of the pivot pin 46, serves to exert a substantial detent and restoring force on the pivot pin 46 so that when the door 20 is closed, there will be a sufficient force tending to hold it closed. When the door 20 is opened part way, there will be a substantial restoring force tending to close the door, but when the door 20 is opened fully (e.g. at 90° to its closed position), then the pressure assemblies 120 will press directly on the curved surfaces 53 of pivot pin 46 and will not exert any closing force on the door.

Because each side surface 100, 102 of the block 74 contains two bores, and because the bores are opposed, the block 74 can be made relatively thin and therefore more attractive, while still allowing sufficient force to be exerted on pivot pin 46. In addition, the opposing location of the bores balances the forces on pin 46 and aids in smoother operation.

Where the fixed portion of the hinge is to be mounted on glass, as at the top of the door 20, then the arrangement shown in FIG. 6 for hinge 24 may be used. Hinge 24 includes a hinge member 60 identical with hinge member 60 of FIG. 3, but secured to the top of the door 20, and a fixed hinge member 130 secured to glass wall or plate 16. In FIG. 6 corresponding reference numerals indicate parts corresponding to those of FIGS. 1 to 5 for the hinge member 60.

As shown in FIG. 6, the fixed hinge member 130 takes the form of two clamping plates 132, 134, of the same form as clamping plates 60, 64 and having a central block 136 therebetween also of the same form as block 74. Thus, externally, when hinge member 130 is mounted on glass, it will be indistinguishable visually from hinge member 60.

However in the FIG. 6 arrangement, block 136 has in its flat end surface 138 a square recess 140 adapted to receive the square end 42 of pivot pin 46. A bore 142 extends through block 136, aligned with bore 82, and terminates in a recessed enlarged end 144 adapted to receive an elongated screw 146. The screw 146 can therefore be inserted into bore 142 and into the threaded bore 54 in pivot pin 46, to secure the two hinge members 60, 130 together. Either before or after this has been done, hinge plate 134 is attached to hinge plate 132 as previously described, to secure the two hinge plates together.

Although preferred embodiments of the invention have been described, various changes may be made within the scope and spirit of the invention.

I claim:

1. A two-part glass hinge assembly comprising:

(a) a first hinge member adapted to be clamped to a glass plate and comprising:

(i) first and second plate portions adapted to lie in parallel planes one on each side of said glass plate and having a pair of ends lying in a common plane, (ii) a block portion of smaller lateral dimensions than those of said plate portions and adapted to lie between said plate portions and to be connected thereto, (iii) said block portion having a flat end lying in said common plane, said flat end thereby being flush with said ends of said first and second plate portions, said block portion having first and second side surfaces extending at right angles to said flat end and to the planes of said plate portions, (iv) said block portion having a first bore extending into said block portion perpendicular to said flat end thereof, said bore having an inner closed end, (v) said block portion having second and third threaded bores in said first side surface thereof and fourth and fifth threaded bores in said second side surface thereof, each of said second to fifth bores extending perpendicular to its respective side surface and intersecting said first bore, (b) a second hinge member adapted to be connected to a support structure and having a flat end surface adapted to overlie said flat end of said block portion, (c) a pivot pin non-rotatably connected to and protruding from said end surface of said second hinge member and extending into said first bore, said pivot pin being rounded in cross-section but having a pair of opposed flat surface portions one extending along each side thereof, and having a free end adjacent said inner closed end of said first bore, (d) pressure pad means located in each of said second to fifth bores for resiliently pressing on said flat surface portions of said pivot pin to bias said pivot pin to a selected position relative to said first hinge member, (e) each of said pressure pad means including spring means, and adjustable screw means for adjusting the pressure of each of said pressure pad means on said pivot pin.

2. An assembly according to claim 1 wherein said second hinge member is a substantially flat bar.

3. An assembly according to claim 1 wherein said second hinge member includes third and fourth plate portions of the same size as said first and second plate portions respectively, and a block portion between them of the same size as said first mentioned block portion.

4. An assembly according to claim 1 wherein said pivot pin includes a square end, said second hinge member including first and second opposed surfaces, said first surface having a square recess therein, said square end adapted to be snugly fitted into said square recess, and screw means extending from said second surface of said second hinge member through said second hinge member into said pivot pin, thus to secure said pivot pin to said second hinge member.

5. The assembly according to claim 4 and including a plastic pad between said free end of said pivot pin and said inner end of said first bore.

6. The assembly according to claim 4 wherein each said pressure pad means includes a plastic bushing adapted to press on one of said flat surface portions of said pivot pin, a coil spring adapted to press on said plastic bushing, and an insert screw adapted to retain said coil spring and said plastic bushing in said second to fifth bores.

* * * * *